United States Patent [19]

Holand

[11] Patent Number: 4,478,018

[45] Date of Patent: Oct. 23, 1984

[54] THERMAL BREAK EXTERIOR INSULATED WALL FRAMING SYSTEM

[76] Inventor: John F. Holand, 1704 Danby Rd., Ithaca, N.Y. 14850

[21] Appl. No.: 287,590

[22] Filed: Jul. 28, 1981

[51] Int. Cl.[3] ..... E04B 2/00

[52] U.S. Cl. ..... 52/220; 52/241; 52/243; 52/404

[58] Field of Search ..... 52/404, 407, 481, 281, 52/243, 241, 309.9, 309.11, 220, 406; 411/44, 501

[56] References Cited

U.S. PATENT DOCUMENTS

| | | | |
|---|---|---|---|
| 928,947 | 7/1909 | Dawson | 411/501 |
| 1,673,118 | 6/1928 | Lawrence | 52/281 |
| 2,209,816 | 7/1940 | Grapp | 52/404 |
| 3,305,993 | 2/1967 | Nelsson | 52/404 |
| 3,474,583 | 10/1969 | Manias | 52/309.11 |
| 3,531,901 | 10/1970 | Will | 52/404 |
| 3,828,502 | 8/1974 | Carlsson | 52/309.11 |
| 4,058,949 | 11/1977 | Bellem | 52/407 |

FOREIGN PATENT DOCUMENTS

| | | | |
|---|---|---|---|
| 2535913 | 2/1977 | Fed. Rep. of Germany | 52/281 |
| 2305105 | 10/1976 | France | 52/730 |
| 670441 | 4/1952 | United Kingdom | 52/481 |
| 1042283 | 9/1966 | United Kingdom | 52/481 |

*Primary Examiner*—Henry E. Raduazo

*Attorney, Agent, or Firm*—Barnard & Brown

[57] ABSTRACT

A wall framing system using thermal-break studs comprising two half-studs located on opposite sides of insulating material, and top and bottom channels into which the insulating material is inserted, and to which the half-studs are fastened. The half-studs may be tied together, compressing the insulating material, for additional strength.

4 Claims, 8 Drawing Figures

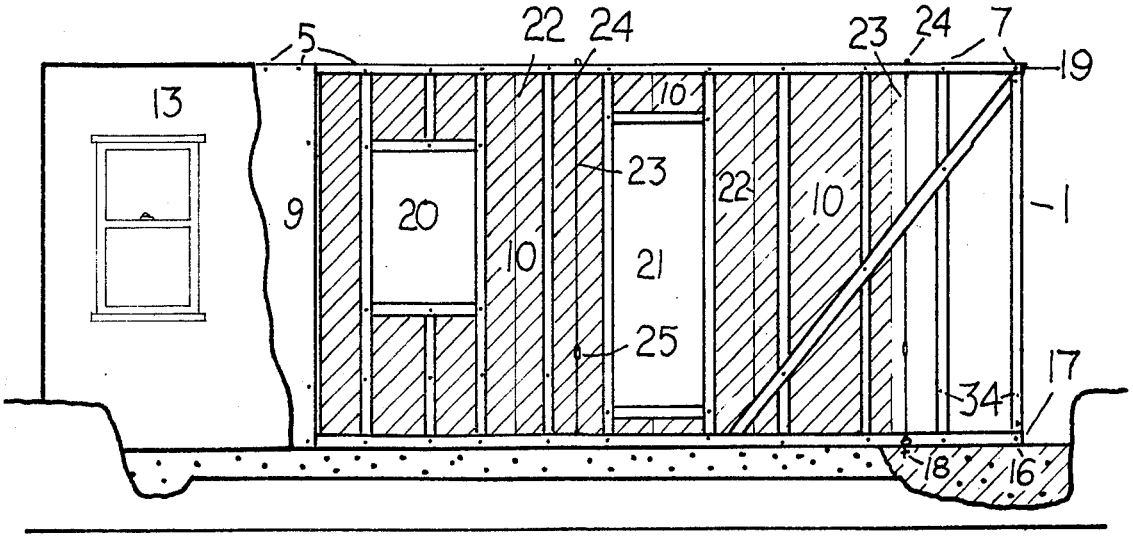
FIG.4
FIG.5
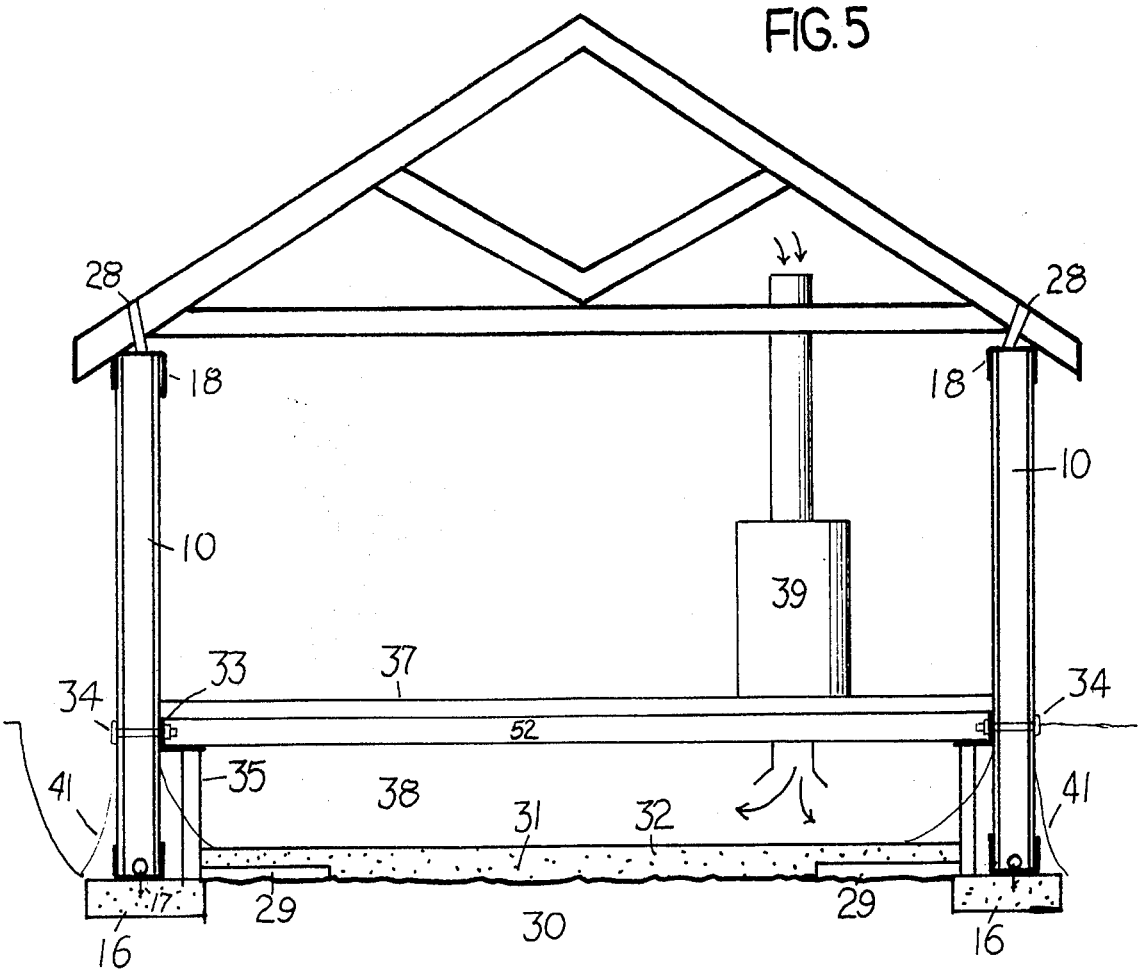

THERMAL BREAK EXTERIOR INSULATED WALL FRAMING SYSTEM

FIELD OF THE INVENTION

The invention pertains to loadbearing insulated exterior wall framing systems.

DESCRIPTION OF THE PRIOR ART

In the United States before the Civil War, houses were built in the log cabin style or in the post and beam method of structural framing. After the Civil War with the opening of the American West to homesteading, the invention of the wood 2×4 produced the balloon framing system which was more efficient and economical in the utilization of lumber and allowed people to build economical homes where trees were far and few between, and lumber had to be hauled long distances by horse and wagon.

Balloon framing is rarely used today, having been replaced in modern residential construction by platform framing (also called western framing) which still utilizes the wood 2×4 or a light-weight metal stud with the same nominal dimensions of a wood 2×4.

With the rapidly increasing cost of energy used in home heating and cooling, a multitude of ways of insulating homes have been invented. Most common is the method of using friction batts of spun fiberglass, or blocks of rigid polystyrene foam inserted into the wall cavities between the studs, or blowing cellulose, rock wool, or urethane foam into the wall cavities.

In order to achieve an R-20 exterior wall insulation value, which is required by HUD Minimum Property Standards in new home construction, builders have increasingly started to use 2×6 construction framing instead of 2×4's in order to stuff another 2 inches of insulation into the wall cavity, which is a waste of good lumber.

However, in all frame construction, no matter how much or what type of insulation is installed between the studs, there is still the underinsulated area of these studs themselves to consider. This framing area, known as the framing factor, varies between 18 and 27% of the total opaque exterior wall area depending on construction. In effect the studs are an insulation short circuit between the exterior and interior sides of the wall.

In order to overcome this drawback, builders have started nailing insulating sheathing over the exterior side of the studs. This insulating sheathing varies in thickness from ¼ inch to 3 inches or more. The thicker the sheathing, the longer the nails and then the harder it is to nail any kind of siding on top of it, let alone trying to locate the stud to nail to.

However, installing sheathing over the stud creates the problem of trapped water vapor within the wall cavities between the studs with resultant condensation accumulating in porous cavity insulation materials. Any insulating material which absorbs moisture can lose insulating value because water is an excellent conductor of energy. In order to prevent this condensation, especially in colder climates, a polyethlene vapor barrier has to be installed on the warm side of the wall and then the wall cavities must be vented to outside air with vents or vent strips. However, the venting permits air infiltration into the wall cavity, which, in turn, causes heat loss through a phenomenon known as convective looping, which is the tumbling of air within the wall cavity which transfers heat energy from the interior side of the wall to the exterior side of the wall by convection. Because of all these short comings with conventional framing systems, there has been a rush of factory-made prefabricated insulated modular wall panels onto the housing market. They have a myriad of drawbacks, chief of which is that they are more expensive than conventional framing and have less flexibility of architectural design.

DESCRIPTION OF THE DRAWINGS

FIGS. 4 and 5 are a cut-away view of a house built as taught by the invention.

SUMMARY OF THE INVENTION

The present invention overcomes the foregoing problems of conventional framing and provides an extremely simple and economical framing system employing two piece steel studs which are easily positioned and installed by two workmen.

Figure 1:
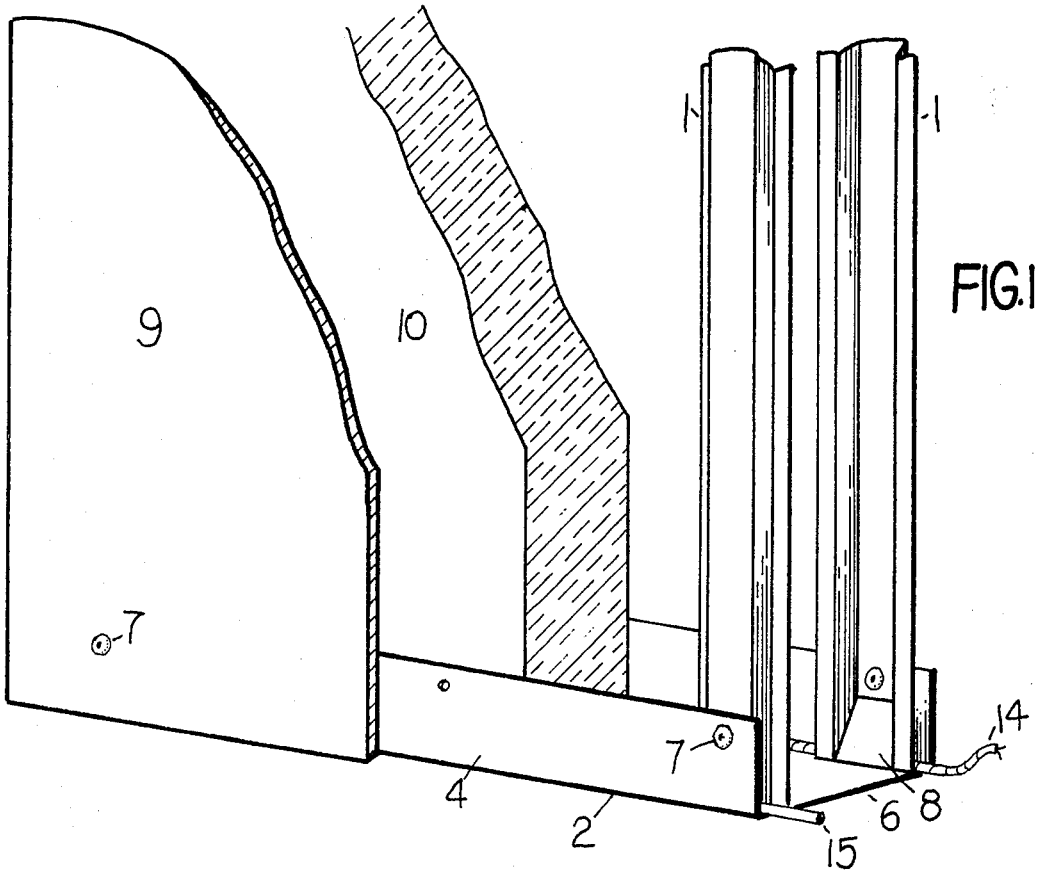
FIG. 1 shows a close-up view of the wall elements of the invention.
Figure 2:
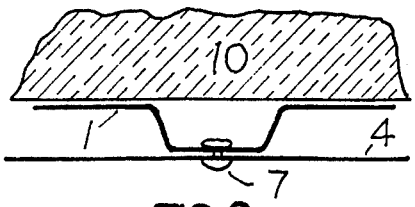
FIGS. 2 and 3 show a top view of alternate arrangements of the stud elements.
Figure 3:
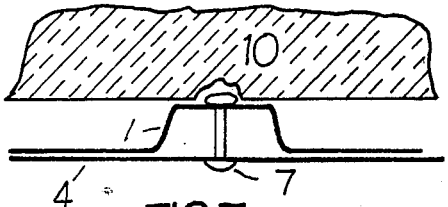

Referring to FIG. 1, the key to the system is the two-part metal stud. The two pieces of the stud (1) (or "half-stud") are identical. They can be made by the high-speed roll-forming method by which a strip of metal of the desired gauge is passed through rollers to form the desired shape, or by any other convenient method. The manufacturing system preferred is the method used to produce the light steel structural shape known to those skilled in the art as a "hat section."

Metal U-beam channels (2) are preferably used to form the top and bottom, plates of the exterior wall, although a channel-like structure made up of two pieces of angle stock, spaced apart, could be used. This channel may have holes (3) drilled or punched along its entire length on both sides of the vertical side surfaces (4) of the channel. The diameter of the hole is determined by the thickness of the type of self-expanding rivets (7) to be used to fasten the half-studs to the channel.

The half-studs (1) are positioned opposite each other, spaced preferably on 16-inch centers, along the lengths of the channels and fastened to the vertical side surfaces (4) of the channels (2), preferably with self-expanding rivets (7). Every so often where it will be convenient, a half-stud on one side of the wall will be left out so that rigid insulation sheathing board (10) stock, preferably of 4×8 foot sheets or larger, can be inserted and slid into position between the channels, so as to adjoin each other tightly along one edge, if it is desired to use such rigid board as in the preferred embodiment.

The thickness of the rigid insulation sheathing board (10), if used, depends on the desired R-value needed in the wall. The width of the steel channel wall plate will depend on the thickness of the insulation used.

As used in this specification, "insulation" means any substance which retards or blocks heat transfer, or which reflects heat. Instead of the insulation board used in the preferred embodiment, it will be recognized that any other insulation could be used, from a sheet of reflective aluminum foil to any of the many forms of insulation mat or foam, without sacrificing the benefits of the invention. Preferably, the insulation chosen will not be effected by moisture, and will form a vapor barrier between the inside and outside of the wall.

Allowing an inch for the half-stud on each side of three inches of the high-grade insulation sheathing board plus ½-inch gypsum dry wall on the interior and ¾ inch acrylic cement plaster over galvanized self-furring metal lath on the exterior, as done in the preferred embodiment of the invention (see FIG. 6), will produce the 6¼-inch exterior wall which is common for exterior walls with plaster interior. This standard wall thickness is desirable for accommodating conventional prefabricated window and door jamb units resulting in cost savings.

In the preferred embodiment, the half-studs (1) are tapered (8) at the tops and bottoms where they meet the channels (2). Tapering the studs forms a space through which ½-inch copper or plastic plumbing lines (15) or electrical wiring (14), can be run. Alternatively, the insulation can be notched just inside the half-studs (see FIG. 6), to form the same type of gap. Electrical wiring (14) can be held in place if needed with plastic snap ties. Electrical outlet and switch boxes are easily fastened to the studs which provide a secure base. This results in considerable savings over prefabricated custom made modular wall panels with an expanded plastic foam core sandwiched between inner and outer skins, because if the foam core walls are not prewired or preplumbed, considerable time is required to insert electrical wiring or plumbing lines within passages or channels formed within the foam core before the skins are attached. Also, local plumbing and electrical inspectors like to look at what they are inspecting to see if it meets local codes. Moreover, the system represents a considerable improvement over conventional panelized wood stud walls where considerable drilling in the top plate and a maze of wires run across the attic lead to multiple potential air leaks for air infiltration.

DESCRIPTION OF THE PREFERRED EMBODIMENT OF THE INVENTION AS USED IN BUILDING A HOUSE

FIGS. 4 and 5 represent a partially cut-away side view and end cut-away view, respectively, of a house built according to the teachings of the invention. In building a structure using this wall framing system, only a shallow concrete or gravel footing (16) is needed because of its light weight compared to other forms of construction such as concrete block. When the concrete footing has been placed and screeded level, the bottom channels (17) are laid on the fresh concrete and slid back and forth until they are dead level. If it is a hurricane area, eyebolts with anchors (18) are embedded in the fresh concrete through holes drilled in the bottom of the channel.

Now two structural steel angles of the desired wall height, forming the inside and outside corners, are placed in each of the four corners of the house. They are raised vertically perpendicular to the horizontal bottom channel plate, one forming the inside corner, and the other forming the outside corner where two walls meet in a corner. They are braced and plumbed on both sides by adjustable tubular steel braces placed diagonally from the tops of the structural angles to the bottom channels and fastened to predrilled holes in the flanges of the angle and in the flanges of the channel. When all four corners of the house have been aligned and plumbed, the top plate U-beam channels (19) are lifted into place, one end at a time, around the building on all four sides. This way the top plate channels are in perfect alignment with the bottom plate channels.

Now the framing for the windows and doors is installed using the same U-beam channel as in the top and bottom plate channels. When the door and window framing has been installed in the desired locations, half-studs (1) are hung from the inside and outside flanges of the top plate channels. Since the half-studs are hanging down, they are automatically as plumb as a plumb bob hanging on a string. The half-studs are then fastened to the bottom channel (17). Next the rigid insulation boardstock (10) is inserted into the wall and slid into place along the channels with edges adjoining each other butt to butt with their joints taped with aluminized tape (22).

The insulation boardstock preferably has a surface covering of heat-reflective material (53), such as a light metal foil cladding. Alternatively, reflective foil could be attached to unclad board before or after insertion into the wall. The arrangement of the heat-reflective insulation in the center of the wall, separated by the thickness of the half-studs from the inside and outside sheathing, forms two air-gaps (54) divided by a reflective and insulating means. This provides a uniquely effective insulating quality to the wall.

Then wire rope (23) is attached to the eyebolts (18) in the bottom channel (17) and attached to eyebolts (24) fastened in the top channel (19) and tightened with turnbuckles (25). At the same time wire rope is also run diagonally to the top and bottom channels and adjusted with turnbuckles to plump and align all four walls at once. After the wall is plumb, steel strap bracings (26) accepted by FHA or local building codes is installed in a cross brace fashion to increase wall bracing and racking strength. With the walls braced, the roof trusses (27) are lifted into place. In hurricane areas, steel hurricane straps (28) are riveted to the top channel to tie down the roof truss ends.

The inside and outside sheathing, of whatever type, can now be applied over the half-studs.

Next the floor can be installed. First expanded or extruded polystyrene rigid insulation (29) is laid covering the concrete footing (16) and the earth floor (30). This is covered with plastic film vapor barrier (31). This can be covered with a thin layer of sand or woven wire mesh can be laid and covered with a thin layer of concrete (32).

Next a steel U-channel ribbon beam (33) is installed along two opposing walls at the desired floor height. The steel channel floor ribbon beam is fastened to the studs of the wall with bolts that run from the outside half-stud, through the inside half-stud into the ribbon beam (35). The ribbon beam can be additionally supported by a steel post sitting on top of the concrete footer. Now steel joists (52) are run between the ribbon beams. The floor decking (37) can be laid out of ½ inch cement fiber board used in steel roof decks, which material is ideal because it doesn't burn and is designed for use with steel framing and fasteners, or the floor can be made of plywood or concrete poured over metal lath, or whatever is desired.

This makes possible an underfloor plenum which utilizes a downdraft furnace (39) to heat the house. The house can also be cooled by installing the A-Frame of the air conditioning element below the furnace using the same blower for forced air. The use of an underfloor plenum eliminates the crawl space that must be vented and heavily insulated or the floor will be cold and heat lost to the draft blowing under the house.

If it is to be a two-story house or a one-story house with a full basement, a second steel floor framing may be added above the first floor or basement floor, but the downdraft furnace remains on the first floor installed above an underfloor plenum. Sheet metal ducts could then be fastened to the inside of the exterior walls, covered with self-furring plaster key mesh and plastered with the type of plaster used to cover heating cables in radiant ceilings. This way conditioned air is brought to the upper story while the basement or first floor is warm enough for a slumber party, turning full basements into living areas.

Since the steel studs can be made in various lengths from eight to eighteen feet, the floor level can be situated any height from a shallow underfloor plenum to a full basement. Or the floor can be raised to the height above sea level required by building codes in coastal areas, still utilizing the underfoor plenum.

The two piece thermal-break loadbearing steel stud eliminates the need for concrete block, reinforced concrete or all weather wood foundation or basement walls. It is a foundation wall and an exterior above ground wall all rolled into one. The wall won't rot, decay, or burn; it is termite proof; and if paraged correctly with cement plaster, forming a cove (41) where the wall is attached to the concrete footer, it won't leak water and above all, it is insulated.

Figure 6:
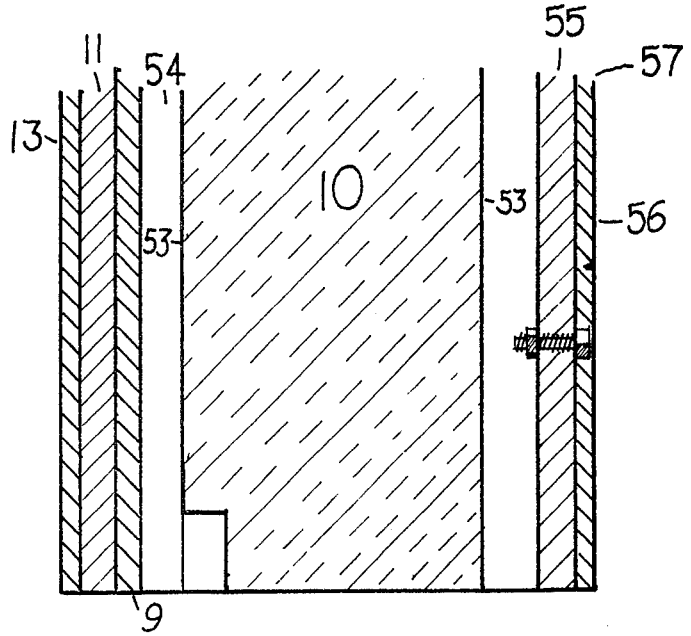
FIG. 6 is a sectional detail of one method of surfacing the wall as taught by the invention.
Figure 7:
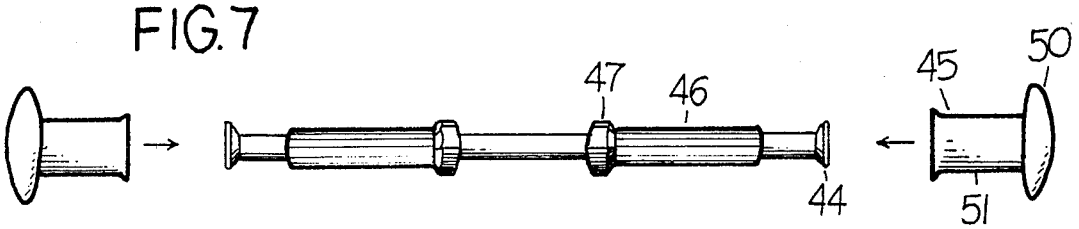
FIGS. 7 and 8 show the means used to tie the vertical studs together in the preferred embodiment.

Referring to FIG. 6, the outside surface of the exterior wall can be plastered over 3.4 lb. galvanized self-furring expanded metal lath of the K- or Diamond mesh type (9) with an acrylic cement plaster made with sand, portland cement and acrylic polymers and modifiers in liquid form replacing part of the mixing water, such as Acryl 60 produced by Thoro System Products of Miami, Fla. This plaster may be applied by trowel or plaster pump and spray gun in a ¾-inch thick layer (11) over all exterior surfaces of the outside walls. After 24 hours, a cement base foundation coating, such as Thoroseal, also with a Acryl 60 added, is applied to below ground surfaces. Above ground surfaces receive a Plaster Mix, such as Thoroseal®, which is topped by a color coat, (13) such as Thorocoat®, (which is a 100% acrylic, non-cementitious, textured coating designed to protect as well as decorate). Foil-backed gypsum base (55) is installed with self-tapping drywall screws (56) on the interior side which receives a one-coat hard veneer plaster. An exterior wall only 6¼ inches thick, that has no framing factor, no convective looping, no moisture condensation, with an R-21 value, is a significant achievement in loadbearing wall technology.

For ASHRAE winter design purposes using the ASHRAE 1977 Fundamentals Handbook: If foil-backed gypsum drywall is exposed to a one-inch air space, another R-3 is added to the wall for each space. In the preferred embodiment of the invention, there are two dead air spaces created, which gives a composite R-value of 21, not counting the insulation value of the inside or outside sheathing themselves.

If conventional siding is desired instead of stucco and conventional sheets of gypsum drywall are desired instead of plaster drywall or plywood siding with self-tapping screws installed with a screw gun. If vinyl lap siding or cedar shakes are desired, particle board sheathing will have to be installed with a screw gun first. In this manner any kind of siding that can be installed on conventional 2×4 framing can thus be used.

This new framing method would allow small single family houses in the 1,000 square foot range to be "stick built" from scratch just as fast as prefabricated foam core modular wall panel construction with the same manpower and without the aid of expensive cranes used to lift them into place. This framing system can also be used instead of concrete block in high rise construction in nonloadbearing situations such as curtain walls, where the loadbearing requirements are met by steel or reinforced concrete columns, beams and girders. It is also an economical way to build refrigerated or heated warehouses, especially where special gases are used to keep fruit such as apples from spoiling, because there are no air leaks and if there are, they can be detected easily and patched.

The invention teaches a framing system that readily lends itself to computer-aided design. The computer can be programmed to design the spacing of the studs and other framing elements taking into consideration the overall design of the structure and its loadbearing requirements based on such factors as weight of roof trusses, wind loading, snow loading, live loading, soil conditions and pressure of various heights of backfilling against the foundation walls. Thus the computer can design the most economical framing method to suit the needs of the building design and the environment in which it is to be erected. The computer can also be used to manage the building operation. This helps create a new breakthrough in the CAD-CAM environment of computer-aided design and computer-aided management in building contruction.

Figure 8:
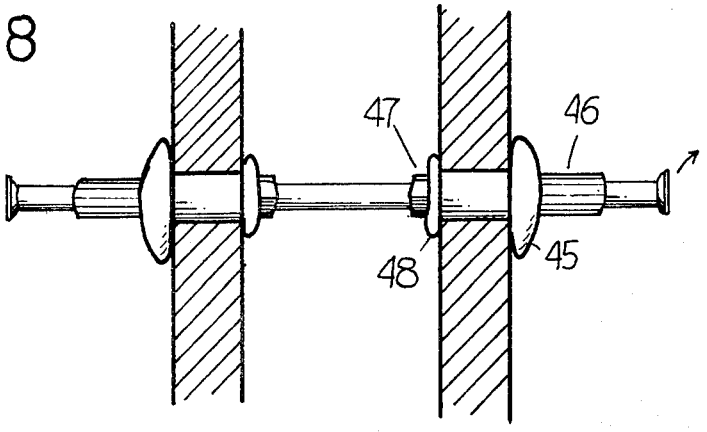

As illustrated in FIG. 8, in the preferred embodiment of the invention the double "T" rivet binds the two halves of the thermal-break stud (1*a*) and (1*b*) together compressing the flanges (42) of each half into the plastic foam core insulating sheathing board about one-quarter inch, thus forming one integral laminated loadbearing member. Compressing the flanges of the two halves against both sides of the plastic foam core insulating sheathing board utilizes the lateral compressive strength of the plastic foam core insulation board which may vary from 18 lbs. to 20 lbs. or more per square inch, especially if the plastic foam core insulating sheathing board is covered on both sides with a layer of metal foil and strong kraft paper. Compressing the halves of the stud together against both sides of the insulation board, utilizes the compressive strength of the board while greatly increasing the rigidity and stability of the stud. If this method of tying the half-studs together is used, the half-studs could be made of relatively light metal. If the insulation is not compressed between the half-studs, then thicker metal will be required.

Referring to FIGS. 8 and 9, the double "T" rivet is composed of three pieces: a pin (43), and two rivet caps (45) made up of head (50) and deformable shank (51) portions. The main piece is the straight pin (43), the diameter of which is determined by the tensile strength desired in the fastener and its overall length is determined by the thickness of the wall. On both ends of the pin is a compression flare flange (44) which is gripped by one part of the nose piece of an air hydraulic riveter, while another part of the nose piece compresses the rivet cap (45) placed on the pin, driving it over a gripping part of the pin (46), which may be fluted, as shown, and compressing it against a wedge-like "T" head (47) on the pin which stops the rivet cap from sliding any farther along the pin and causes part of the rivet cap to swell up (48) and form a rivet on the back of the stud half facing the sheathing (49). The same process is repeated on the other side of the wall through which the pin extends and on which another rivet cap is placed and secured with the air hydraulic rivet causing another rivet to be formed on the back of the other half of the stud, thus turning both halves into one integral laminated insulated thermal-break loadbearing framing member.

Using the double "T" rivet makes possible the creation of a rivet on the backs of both halves of the stud facing the insulation, which in effect causes the pin to act as a spreader bar, keeping both halves of the stud from flexing inward. The head (50) of the rivet caps in turn keeps the stud halves from flexing outward. Compressing both halves against the plastic foam core insulating sheathing board in addition to increasing the overall loading bearing strength of the stud, also helps keep the halves of the stud from flexing sideways across the face of the insulation sheathing board. Thus the use of double "T" rivets greatly increases the rigidity and stablity of the wall structure while forming one integral laminated insulated thermal-break loadbearing structural framing member.

Since this structural framing system was designed to utilize as many different economical types of building materials and methods as possible, various modifications may be made in the structure shown and described without departing from the spirit and scope of the invention.

Accordingly, it is to be understood that the embodiments of the invention herein described are merely illustrative of the application of the principles of the invention. Reference herein to details of the illustrated embodiment are not intended to limit the scope of the claims, which themselves recite those features regarded as essential to the invention.

I claim:

1. A thermal break insulated wall comprising:

a. insulating means for creating a thermal-break, comprising top, bottom, and a plurality of side edges, and two planar surfaces separated by a thickness of insulating material, said thickness determining the insulation value of the wall;

b. two horizontal channel elements, defining the top and bottom of the wall, each channel element having a substantially "U" shaped cross-section with a horizontal surface and two vertical side surfaces meeting at right angles, the horizontal surface of each channel being of suitable dimensions to encompass the thickness of the insulating means between the vertical surfaces;

c. a plurality of metal stud means linearly disposed along the channel elements, each comprising two vertical half-studs placed on opposite sides of the insulating means, the insulating means forming a thermal-break between the vertical half-studs;

d. means for fastening the vertical half-studs of the stud means to the vertical side surfaces of the channel elements, comprising rivet means engagably inserted through holes in the ends of the vertical half-studs and the vertical side surfaces of the channel elements;

e. surfacing means for covering the wall comprising sheet means for creating a solid surface disposed parallel to the planar surfaces of the insulating means, creating air gaps between the surfacing means and the insulating means; and means for fastening the sheet means to the vertical half-studs, and to the vertical side surfaces of the channel elements;

f. tie means for fastening the vertical half-studs of each stud means together, compressing the insulating means firmly between the vertical half-studs.

2. The wall of claim 1 in which the tie means is a double "T" rivet comprising:

a. pin means for forming the tie, the length of the pin means being made up of a center portion and two identical end portions;

b. each end portion of the pin means comprising in order, an innermost segment next to the center portion in the form of a wedge, having a larger diameter end adjacent to the center portion of the pin means; a gripping segment having a diameter equal to the smaller end of the wedge segment; and an outermost segment having a smaller diameter than the gripping segment along its length, with an end flange means greater in diameter than the outermost segment, but less than the diameter of the gripping segment, for engaging the nose piece of a rivet gun;

c. hollow cap means for forming rivets, comprising a deformable shank portion with an inside diameter larger than the diameter of the end flange means of the pin means, but less than the diameter of the gripping segment of the pin means; and a flat head portion having significantly larger outside diameter than the shank portion;

d. said pin means being of a length at least equal to the sum of the thickness of the insulating means and the stud means;

f. said hollow cap means being adapted to be placed upon the end portion of the pin means and driven forceably over the gripping segment against the wedge segment, causing the shank portion of the cap mean to flareably deform, forming a rivet rigidly attached to the pin means;

g. said double "T" rivet adapted to be used by the steps of driving the pin means through one vertical half-stud, through the insulating means and through the opposite vertical half-stud; placing a hollow cap means onto the gripping segment and into the wedge segment, forming a rivet around one vertical half-stud, as aforesaid; repeating the above two steps for the other end portion of the pin means.

3. A thermal break insulated wall comprising:

a. insulating means for creating a thermal-break, comprising top, bottom, and a plurality of side edges, and two planar surfaces separated by a thickness of insulating material, said thickness determining the insulation value of the wall;

b. two horizontal channel elements, defining the top and bottom of the wall, each channel element having a substantially "U" shaped cross-section with a horizontal surface and two vertical side surfaces meeting at right angles, the horizontal surface of each channel element being of suitable dimensions to encompass the thickness of the insulating means between the vertical surfaces;

c. a plurality of metal stud means linearly disposed along the channel elements, each comprising two vertical half-studs placed on opposite sides of the insulating means, the insulating means forming a thermal-break between the vertical half-studs;

d. means for fastening the vertical half-studs of the stud means to the vertical side surfaces of the channel elements, comprising rivet means engagably inserted through holes in the ends of the vertical half-studs and the vertical side surfaces of the channel elements;

e. surfacing means for covering the wall comprising sheet means for creating a solid surface disposed parallel to the planar surfaces of the insulating means, creating air gaps between the surfacing means and the insulating means; and means for fastening the sheet means to the vertical half-studs, and to the vertical side surfaces of the channel elements;

f. the half-studs of the stud means being formed with a tapered portion in at least one end, adapted to forming a gap next to the half-stud to allow room for electrical cabling or the like.

4. A thermal-break stud for forming an insulated wall, comprising:

a. two substantially identical metal half-studs equal in length to the desired wall heights, the half-studs being formed with a tapered portion in at least one end, adapted to forming a gap next to the half-stud to allow room for electrical cabling, plumbing or the like;

b. rigid insulation means for preventing heat transfer, having a vertical dimension equal to the length of the half-studs; and a horizontal dimension at least as wide as the half-studs;

c. said insulating means being located between the half-studs;

d. tie means for compressing the insulating means between the half studs.

* * * * *